US005700986A

United States Patent [19]

Rürup et al.

[11] Patent Number: 5,700,986

[45] Date of Patent: Dec. 23, 1997

[54] SWITCHING LEVERS HAVING SELECTIVELY VISIBLE MARKING AREAS

[75] Inventors: Claus Rürup, Porta Westfalica; Lothar Roland Hennemann, Enger, both of Germany

[73] Assignee: WAGO Verwaltungsgesellschaft mbH, Minden, Germany

[21] Appl. No.: 565,001

[22] Filed: Nov. 30, 1995

[30] Foreign Application Priority Data

Dec. 1, 1994 [DE] Germany ..... 44 44 556.3

[51] Int. Cl.[6] ..... H01H 9/00

[52] U.S. Cl. ..... 200/50.32; 200/308; 200/DIG. 6

[58] Field of Search ..... 200/50.01, 50.02, 200/50.03, 50.11, 50.32–50.36, 50.4, 308–312, DIG. 6; 361/622–658

[56] References Cited

U.S. PATENT DOCUMENTS

| | | | |
|---|---|---|---|
| 2,638,012 | 5/1953 | Lewis | 200/DIG. 6 |
| 2,703,827 | 3/1955 | Gelzheiser | 200/DIG. 6 |
| 3,801,758 | 4/1974 | Shand et al. | 200/50.33 |
| 5,038,008 | 8/1991 | Pommier | 200/309 |

*Primary Examiner*—J. R. Scott
*Attorney, Agent, or Firm*—Salter & Michaelson

[57] ABSTRACT

The invention concerns switchable serial terminals with a switching lever gripping component consisting of an insulating material. It is suggested that one provide the gripping component with two visual surfaces—of which in each of the two switching positions of the switching lever and in an alternating manner—one visual surface is turned toward the viewing direction of the operator and, in the same switching position, the other visual surface is turned away from the viewing direction of the operator.

5 Claims, 1 Drawing Sheet

SWITCHING LEVERS HAVING SELECTIVELY VISIBLE MARKING AREAS

BACKGROUND AND SUMMARY OF THE INVENTION

The invention concerns a switchable serial terminal that is capable of being inserted next to other terminals on a supporting bar. The terminal has a switching lever with a gripping component on the switching lever comprising an insulating material that can be actuated manually by an operator.

A positioning problem that is present in non-switchable serial terminals is very big in the case of switchable serial terminals. Serial terminals are usually constructed in the form of disks with a narrow breadth and are inserted transversely on a supporting bar in order to form a terminal block. Accordingly, only one narrow strip-shaped front surface of the serial terminal is ever available to the serial terminal (considered in the viewing direction of the operator or, as the case may be, the installer), whereby the connection locations for the circuitry have to be accessible and inscribed (designated) on the front surface as well as signal displays, test contacts or test sockets, plug openings for bridging systems or similar arrangements that are optionally integrated into the terminal. The position on the narrow front surface of the serial terminals is, accordingly, fully occupied and the ability to gain an overview in regard to the circuitry and operation of such serial terminals is very limited in the normal situation.

These problems become even more serious if one is dealing with a switchable serial terminal of the type from which the invention starts out. Such switchable serial terminals have a switching lever that is capable of being adjusted between two switching positions about an axis of the lever, that extends in the direction of the supporting bar, in such a way that, in one switching position, the gripping component is positioned on one side of a plane in which the lever axis is located and that is defined on the terminal block by the viewing direction of the operator and, in the other switching position, the gripping component is positioned on the other side of this plane.

As a result of this type of actuation of the switching lever, a relatively large pivoting region has to be reserved—on the narrow front surface of the serial terminal—for the gripping component alone of the pivoting lever, as a result of which considerable positioning problems are caused since, in particular, the switching positions of the switching lever also have to be labelled for problem-free operation of the switching lever. This applies, in principle, to all switchable serial terminals independently of which functions of the serial terminals are switched by means of the switching lever.

The task of the invention is to further develop a switchable serial terminal of the type in accordance with the generic type discussed such that the positioning problems on the narrow front surface of the serial terminal are reduced.

In accordance with the invention, this task is accomplished by way of the feature that the gripping component of the switching lever has two visual surfaces of which—in each of the two switching positions and in an alternating manner—one visual surface is turned toward the viewing direction of the operator and, in the same switching position, the other visual surface is turned away from the viewing direction of the operator.

The visual surfaces of the gripping component can be utilized in any suitable manner in order to assign labels/inscriptions thereto. The feature applies in particular, however, that as a consequence of the technical characterizing feature that, in each switching position of the switching lever, only one or the other visual surface of the gripping component is ever turned toward the operator, the new serial terminal is superbly well suited to indicate to the operator—by means of appropriate labels/inscriptions on the visual surface—the switching position in each case of the terminal. This makes the operation of the switching lever more lucid and prevents erroneous switching. Also, it saves space since the gripping component of the switching lever is utilized in a double manner in the new mode.

A further advantageous form of embodiment of the new switchable serial terminals provides for the situation that at least one visual surface of the gripping component has a recess for the insertion (clicking into position) of a terminal designation badge. As a result, the visual surface of the gripping component can also be utilized in order to insert conventional commercial designation badges for the serial terminals as such in the visual surface recess of the gripping component.

In this connection, it is especially expedient that the visual surface of the gripping component lies in one switching position of the switching lever in a superficially flush manner in the outer contour of the adjacent serial terminals of the terminal block so that then all adjacent terminals of a terminal block (independently of whether they are switchable serial terminals or non-switchable serial terminals) have a recess groove that runs linearly and parallel to the supporting bar as a result of which the conventional commercial inscription badges that are in strip form and that are joined together with tear off separation joints can be inserted in a known rational manner in the progressive recess groove of a terminal block and only the designation diagrams that are placed in each case on a switching lever gripping component have to be removed or, as the case may be, isolated from the designation badge strips.

As a result of such usage of the visual surfaces of the switching lever gripping component, very much space is saved in an intelligent manner on the front surface of the serial terminal. This is because in one switching position of the switching lever—in which one visual surface of the gripping component lies in a superficially flush manner in the progressive recess groove for the inscription badges of a terminal block—this visual surface is used for labeling the serial terminal as such (as an entire entity) and thus simultaneously indicates to the operator that the switchable serial terminal is located in its "normal" switching position or, as the case may be, normal operating position. After swiveling the switching lever into the other switching position, the second visual surface of the gripping component is turned toward the operator and one can indicate on this visual surface that the serial terminal is located in a non-normal switching position, for example a test position in the case of a measurement terminal and a separating terminal.

The space-saving advantage of the above use of the visual surface of the switching lever gripping component is very great. The labeling/inscription of the serial terminal itself and also clear and doubt-free labeling of the non-normal switching position of the switching lever is accommodated at the same place on the front surface of the terminal that is required, in any case, for the pivoting region of the switching lever gripping component.

The gripping components of the switchable serial terminals, that are immediately adjacent in a terminal block, can be coupled by means of a connecting pin or by means of a transparent cap, in such a way that the switching levers of adjacent serial terminals can be operated on a group-wise basis.

BRIEF DESCRIPTION OF THE DRAWINGS

Examples of embodiments of the invention will be elucidated below on the basis of the drawings. The following aspects are shown.

DETAILED DESCRIPTION OF THE PREFERRED EMBODIMENTS

Figure 1:
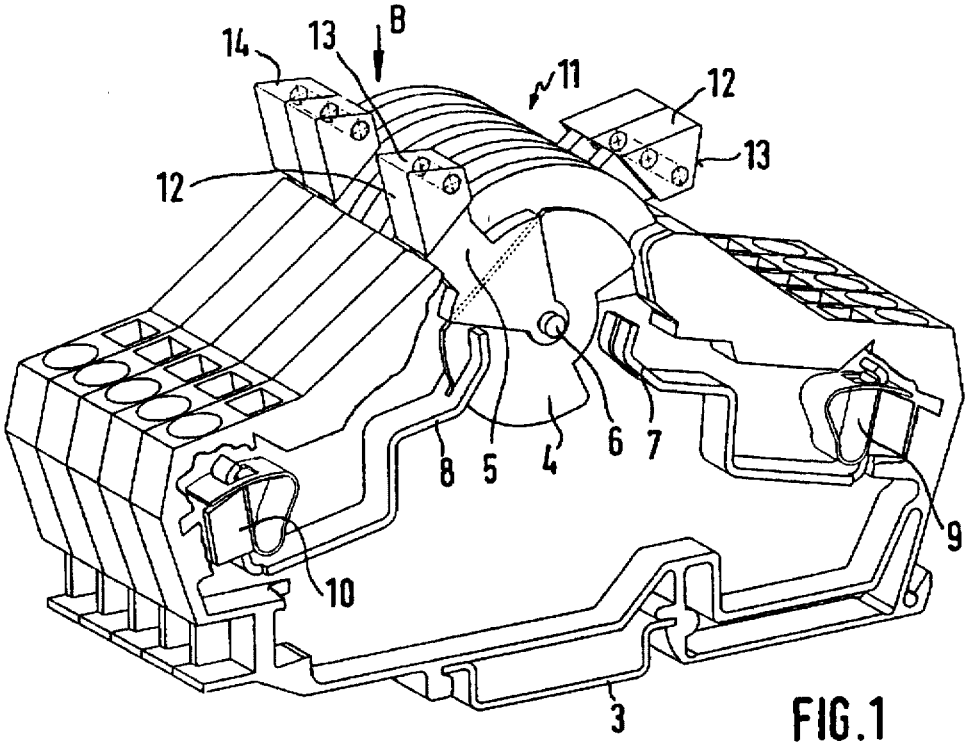
FIG. 1 shows switchable serial terminals in the form of a perspective diagram.

FIG. 1 shows, in total, five switchable serial terminals that have been inserted next to one another to form a terminal block on a supporting bar 3. In each case, the terminal has been constructed identically as separating terminals with a contact disk 4 that is angularly adjustable between two switching positions about the lever axis 6 by means of the switching lever 5 in such a way that, in one switching position, it connects the two conductive connection components 7, 8 to one another or, in the other switching position, it separates these two conductive connection components from one another. The conductive connection subcomponents 7, 8 together form the current passageway of the serial terminal with each of its terminal positions 9, 10 for the external conductive connections.

In accordance with the invention, the switching lever 5 is provided with a gripping component 11 that consists of an insulating material and the gripping component has two visual surfaces 12 and 13 of which—in each of the two switching positions that are illustrated and on an alternating basis—one surface, e.g. 12, is turned in the viewing direction B of the operator and, in the same switching position, the other visual surface, e.g. 13, is turned away from the viewing direction B of the operator.

In the diagram in accordance with FIG. 1, these visual surfaces are illustrated as smooth surfaces on which the inscriptions or labeling can be applied in any suitable way, for example by gluing on a foil or by etching an inscription or something similar.

In order that the switching lever of adjacent serial terminals can be actuated in a group-wise manner, the example of an embodiment in accordance with FIG. 1 provides for the feature that the gripping components 11 of immediately adjacent serial terminals can be coupled to one another by means of a connecting pin that is inserted into the drilled holes 14.

Figure 2:
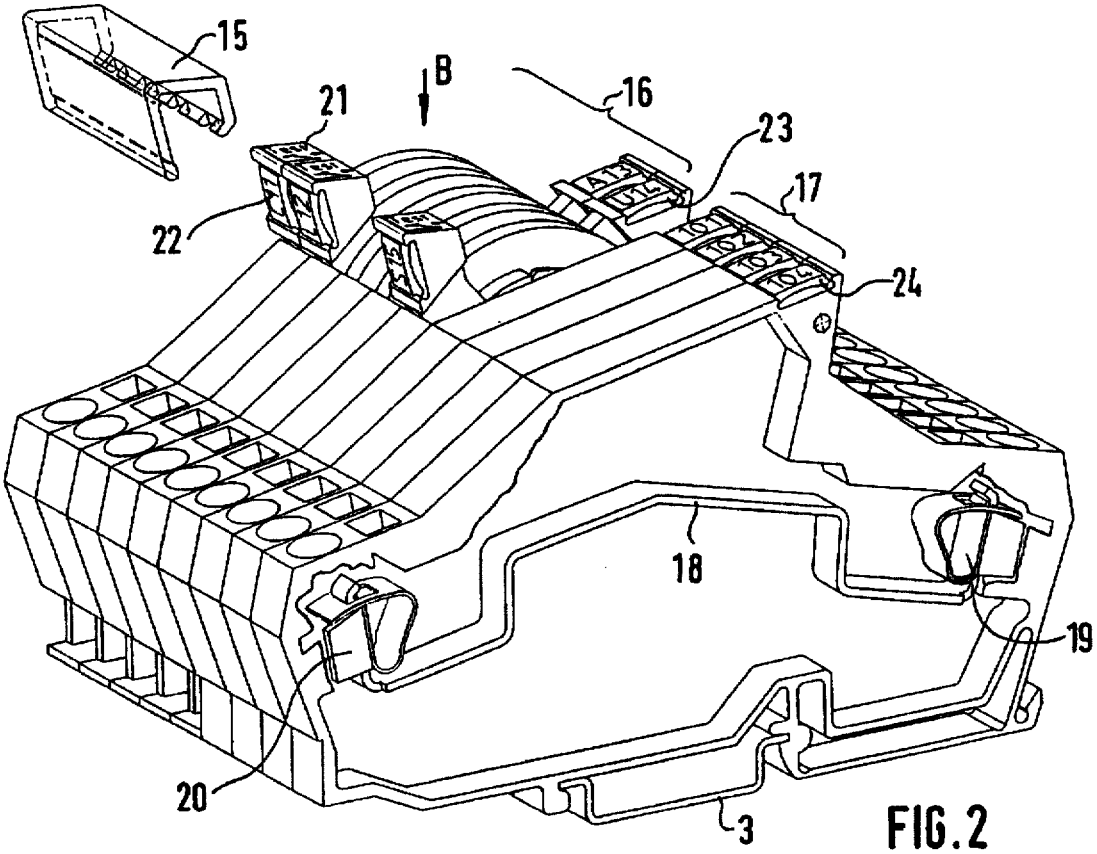
FIG. 2 shows switchable serial terminals in the form of a perspective diagram together with non-switchable serial terminals.

FIG. 2 shows another type of coupling of the gripping components of adjacent serial terminals by means of a cap 15 consisting of a transparent plastic material that is placed on the gripping components and can couple two or more gripping components with one another.

FIG. 2 also shows the mixed arrangement of switchable serial terminals 16 with non-switchable serial terminals 17 on a supporting bar 3. In the present case, the non-switchable serial terminals are simple passageway terminals with a current passage way 18 that again has unilateral terminal positions 19 and 20 of a known type of construction for external conductive connections.

An essential aspect in regard to the present invention is the special construction and arrangement of the visual surfaces 21, 22 of the switching lever gripping component that is illustrated in FIG. 2. The visual surface 21 carries the inscription symbol "test" and thus characterizes for the operator, who looks onto the front surfaces of the terminal block in the viewing direction B, which of the switchable serial terminals is located in the test position, i.e. in a non-normal position.

In the "normal" operating position of the switchable serial terminal that is illustrated in FIG. 2, only the visual surface 22 is turned toward the operator and this visual surface 22 is then located in a superficially flush manner in the exterior contour of the adjacent non-switchable serial terminal 17.

In this regard, the visual surface 22 of the switchable lever gripping component is provided with a recess in order to insert (click into position) a terminal designation badge 23 and such a recess is also present, in a constructionally identical manner, for inserting a terminal designation badge 24 in the case of a non-switchable serial terminal 17. In the normal operating position of the switching lever, the recesses of the switching lever gripping component of the switchable serial terminals 16 are aligned with the recesses of the non-switchable serial terminals 17 and then form a recess groove that runs in linearly and parallel to the supporting bar 3 for inserting terminal designation badges in a way that is known for the latter.

The restful and lucid image of the labeling of a mixed terminal block comprising switchable and non-switchable serial terminals will also be clear on the basis of FIG. 2 when the switching levers of all switchable serial terminals are located in their normal operating position. This good overview is achieved with the lowest demand for space and thereby simultaneously ensures that each switchable serial terminal is clearly recognizable in its non-normal switching position and is also capable of being inscribed in a doubt-free manner.

What is claimed is:

1. In a rail mounted terminal block having a lever switch element for disconnecting the through connection of a circuit, the lever being rotatable about a lever axis and having a handle made of insulating material which is movable from a first switching position on one side of a plane of the terminal block to a second switching position on the other side of the plane of the terminal block, the plane being defined by the lever axis and being generally parallel with respect to a view direction of an operator looking onto the terminal block, wherein the improvement comprises the handle having two marking areas defining visible surfaces, each marking area being adapted to receive a marking, one of said marking areas being visible when the lever is in its first switching position and the other marking area being visible when the lever is in its second switching position.

2. In the terminal block set forth in claim 1, at least one of the two marking areas of each handle having a recess formed therein for receiving a terminal designation badge.

3. In the terminal block set forth in claim 1 further comprising a plurality of switching levers, the marking area of each handle defining a gripping component which is arranged in a superficially flush manner with respect to the external contour of an adjacent lever of the terminal block, and each terminal having a recess groove that runs linearly and parallel to a supporting bar that supports the terminal block for inserting terminal designation badges.

4. In the terminal block set forth in claim 3, the handles of directly adjacent switching levers being connected by a pin.

5. In the terminal block set forth in claim 3, the handles of directly adjacent switching levers being connected by a transparent cap that bridges at least two handles.

* * * * *